United States Patent [19]

Bond

[11] 3,946,955

[45] Mar. 30, 1976

[54] MULTIPLE SECTION WEAR PLATE FOR A ROCK CRUSHER

[75] Inventor: Richard S. Bond, Greenfield, Wis.

[73] Assignee: Rock Industries Machinery Corporation, Milwaukee, Wis.

[22] Filed: Aug. 1, 1974

[21] Appl. No.: 493,911

[52] U.S. Cl. ..... 241/264; 241/291

[51] Int. Cl.[2] ..... B02C 1/02

[58] Field of Search ..... 241/262, 264, 266–269, 241/291

[56] References Cited

UNITED STATES PATENTS

| | | | |
|---|---|---|---|
| 2,487,744 | 11/1949 | Waters | 241/264 X |
| 2,575,301 | 11/1951 | Shafter | 241/264 X |
| 2,828,925 | 4/1958 | Rumpel | 241/267 |
| 3,075,713 | 1/1963 | Kautz | 241/291 |
| 3,804,345 | 4/1974 | De Diemar | 241/264 |

*Primary Examiner*—Granville Y. Custer, Jr.
*Assistant Examiner*—Howard N. Goldberg
*Attorney, Agent, or Firm*—Ronald E. Barry

[57] ABSTRACT

A jaw die assembly for the removeable and stationary jaws of a jaw crusher, the assembly is comprised of a stationary support grid, a center die section secured to said support grid and a pair of identical jaw die end sections, the jaw die end sections being supported on the support grid by interlocking engagement with the center die section and a jaw die extension. Besides having symmetrically identical jaw die end sections which are reversible and interchangeable, the center die section and grid assembly are also reversible, thus utilizing its wear surface area more completely. The center die section, end die sections and jaw die extensions are composed of austinetic manganese steel.

4 Claims, 11 Drawing Figures

MULTIPLE SECTION WEAR PLATE FOR A ROCK CRUSHER

BACKGROUND OF THE INVENTION

In rock crushing equipment, manganese steel is used for the wear surfaces of the crusher plates. This material is required because of its resistance to abrasive materials. However, the availability of manganese has made it virtually impossible to obtain delivery of manganese steel castings in reasonable periods of time. The large size of the crusher plates has also complicated delivery of such materials because of the absence of machining facilities that are available to machine this material. It has also been found that the wear on the crusher plate is less than 30% of the total surface area of the plate and is generally located along the lower edge of the crusher plate. Therefore, a substantial material waste occurs each time the total crusher plate has to be changed. This waste of a critical material, as well as an increase in the cost of the total plate since this material has more than doubled in price within the last year, has been overcome by the present invention.

SUMMARY OF THE INVENTION

The present invention relates to an improved crusher wear plate for a jaw crusher in which the size of the portion of the replaceable wear plate has been reduced, the amount of material usable for the plate has been increased, and the machining problems have been simplified. This has been accomplished by utilizing a steel backing plate or grid assembly to support the crusher plates. Since the maximum amount of wear occurs on the lower portion of the front of the wear plate, a center die section is secured to the back plate and interchangeable upper and lower die plates are locked to the center section. The upper and lower die plates are both reversible and interchangeable thus providing four times the wear surface availability on the lower portion of the wear plate. The center die section and grid assembly also are reversible, thus better utilizing its wear area.

DRAWINGS

DESCRIPTION OF THE INVENTION

Figure 1:
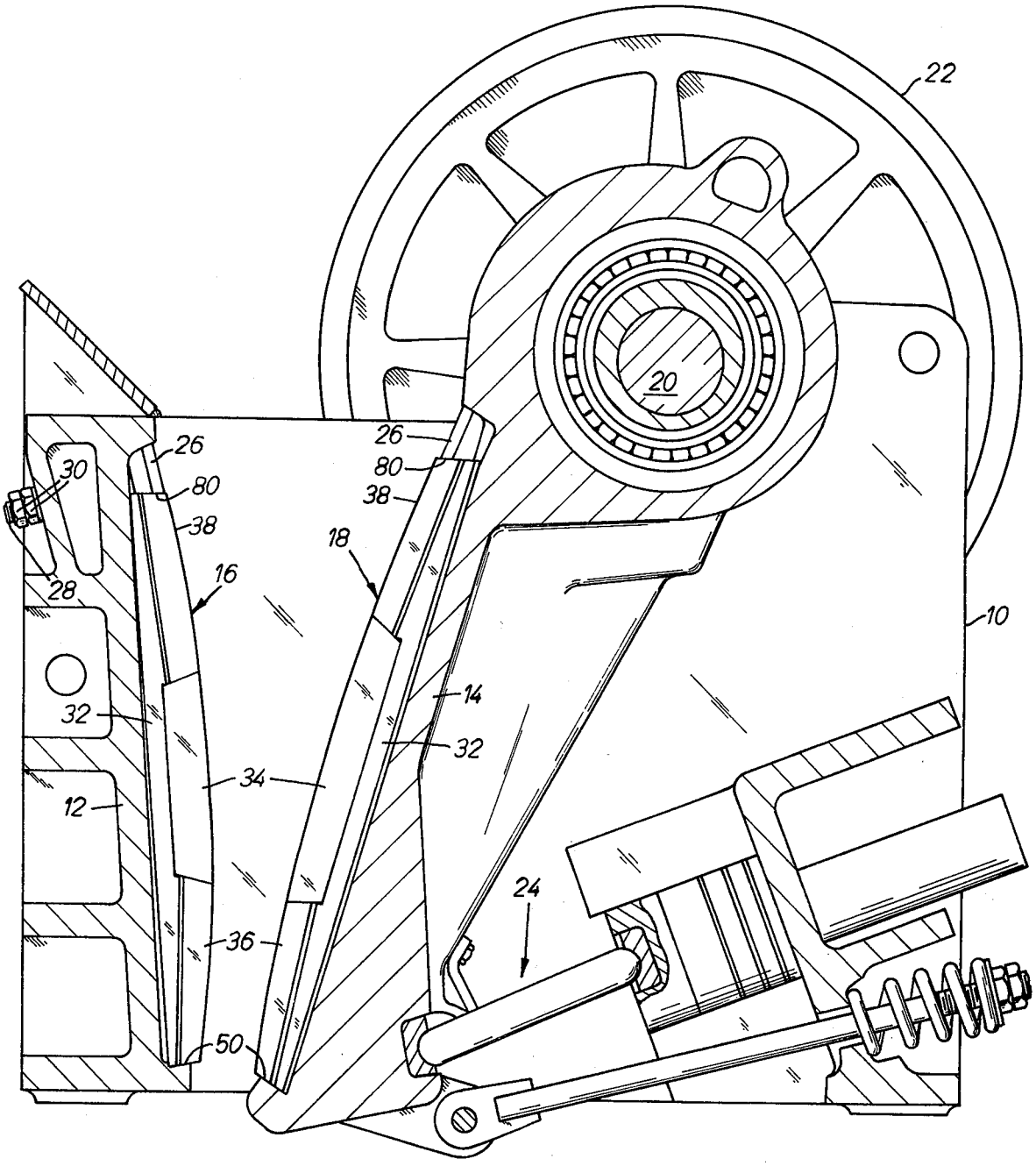
FIG. 1 is a side view in section showing a jaw crusher having the wear plate assembly of the present invention.

A jaw crusher of the type contemplated herein as seen in FIG. 1 includes a frame 10 having a fixed jaw 12 and a movable jaw 14. Each jaw 12 and 14 includes respectively a jaw die assembly 16 and a jaw assembly which are used to crush stone that is fed into the top of the jaw crusher. The movable jaw is reciprocated by means of an eccentric shaft 20 driven off of a fly wheel 22. A toggle assembly 24 is generally provided at the base of the movable die to prevent damage to the movable die in the event the crusher becomes clogged.

The jaw die assemblies 16 and 18 are locked into position by means of a wedge plate or extension 26 mounted at the top of the jaw die assemblies and held in position by a threaded bolt 28 and nut 30. In accordance with the invention, each of the jaw die assemblies 16 and 18 is a multiple unit which varies in size but is generally made up by the same elements.

Figure 3:
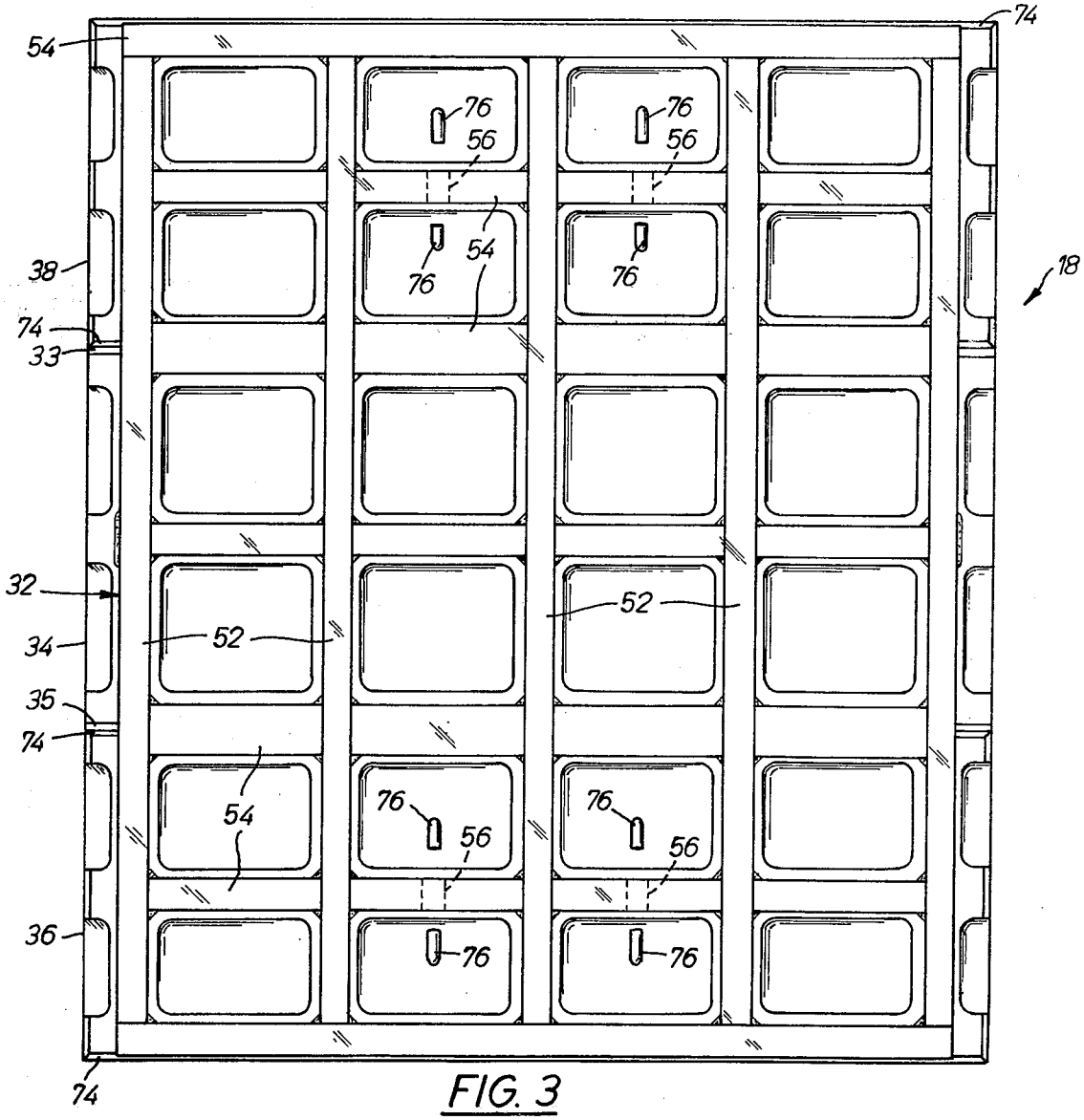
FIG. 3 is a back view of the grid assembly for the wear plate assembly showing the center die section and end die sections in position on the grid assembly.
Figure 2:
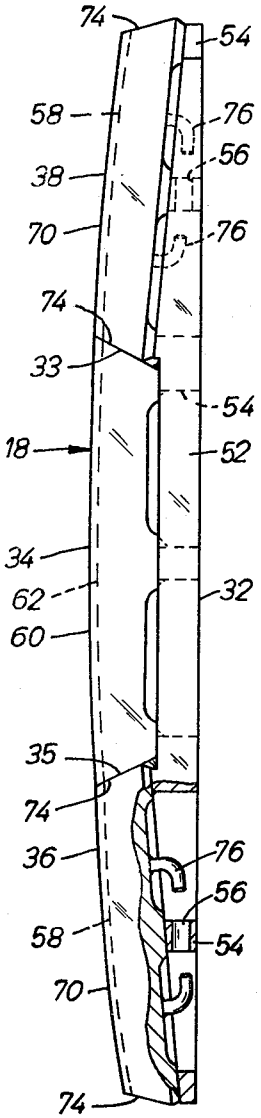
FIG. 2 is an end view of the wear plate assembly.

In this regard, and referring to the jaw die assembly 18 shown in FIGS. 2 and 3, the assembly includes a jaw die grid 32, a jaw die center section 34, a lower end section 36 and an upper end section 38. The center die section 34 is welded to the grid 32 to form a permanent assembly with the grid 32. The end sections 36 and 38 are placed on the grid 32 in abutting engagement with the edges of the center section 34. The jaw die assembly 16 is placed in the jaw 12 of the jaw crusher with the lower edge of lower section 36 supported on a ledge 50 at the bottom of jaw 12. The assembly is wedged in position in the jaw 12 by means of the wedge plate or extension 26.

Figure 11:
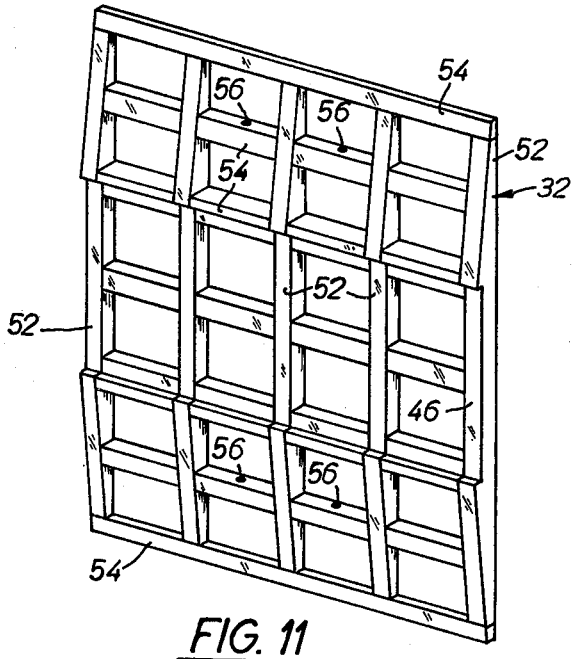
FIG. 11 is a perspective view of the support grid.

More specifically and referring to FIG. 11, the support grid 32 is formed from a low cost stainless steel since it is not subjected to any wear in use. The support grid 32 includes a number of vertical ribs 52 and horizontal ribs 54. A number of holes 56 are provided in two of the ribs 54 for a purpose as described hereinafter.

Figure 10:
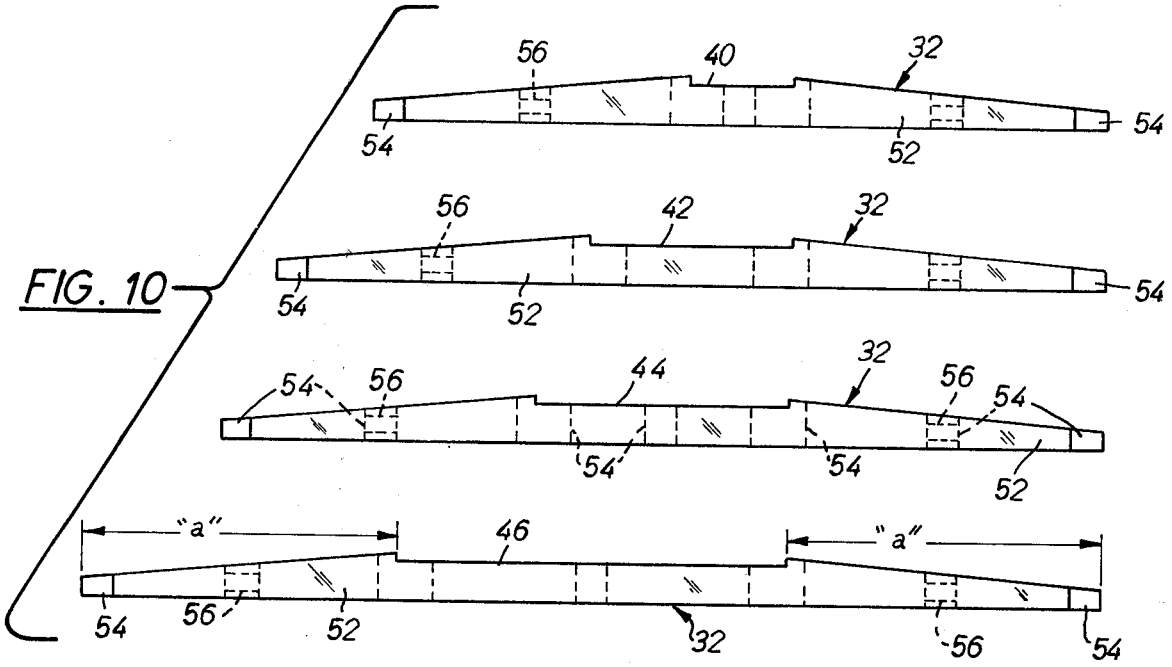
FIG. 10 is a comparitive view of various size grids on which the upper and lower sections can be installed.

Referring to FIG. 10, a number of end views are shown for various size support grids. As seen in the figure, each of the support grids 32 are made with center grooves 40, 42, 44 and 46 of progressively greater width. It should be noted, however, that the distance "*a*" from the edges of the grooves to the edges of the grid 32 are all equal. This arrangement increases the number of variations in which the end sections 36 and 38 can be used.

Figure 9:
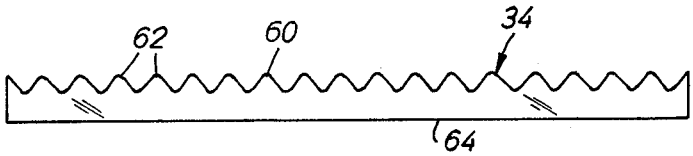
FIG. 9 is a top view of the center section shown in FIG. 7.
Figure 8:
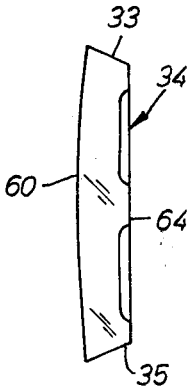
FIG. 8 is an end view of the center section shown in FIG. 7.
Figure 7:
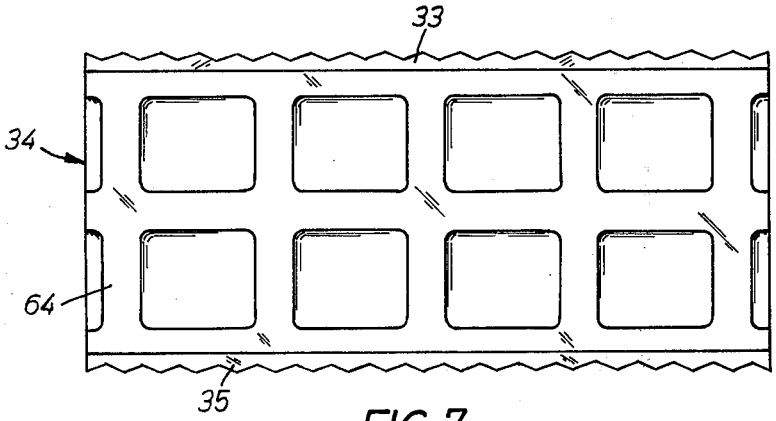
FIG. 7 is a back view of the center section.

The center section 34, FIGS. 7, 8 and 9, of the assembly 16 is cast of manganese steel and has a curved front section 60 having a curvature corresponding to the curvature of the front of the die assembly 16. The center section is provided with a series of vertically extending crushing ribs across the entire length of the center section 34. As is generally understood in crushers of this type, the ribs 62 interengage with corresponding ribs on the crushing surface of the opposite die assembly. The back surface 64 of the center section 34 has a width equal to the width of the corresponding groove 40, 42, 44 or 46 which are provided in the front of the support grid 32. As seen in FIG. 10, the center section 34 can be made as wide as is necessary to seat in the corresponding groove. Each of the center sections are provided with upper and lower inwardly inclined edges 33 and 35, respectively. The edges are inclined from the front surface 60 to the back surface 64.

Figure 6:
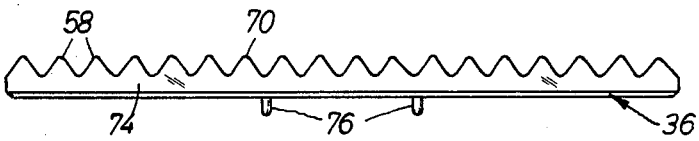
FIG. 6 is a top view of the end section shown in FIG. 5.
Figure 5:
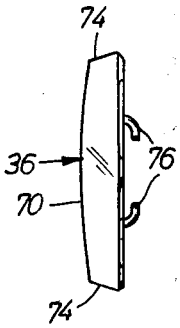
FIG. 5 is an end view of the end section shown in FIG. 4.
Figure 4:
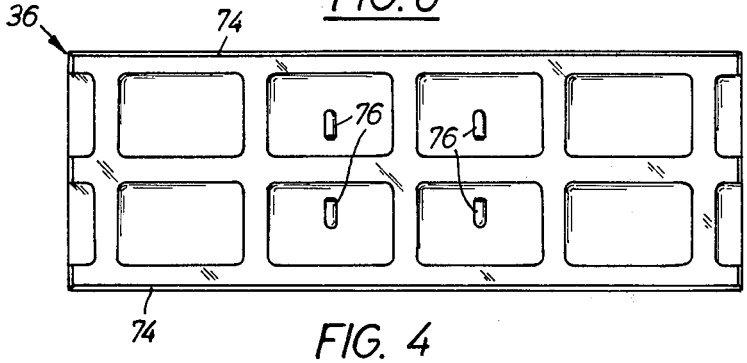
FIG. 4 is a back view of one of the end sections.

Each upper section 38 and lower section 36 is symmetrical and is identical to each other. The sections 36 and 38 are formed from cast manganese steel as used in forming the center section 34. Each of the sections includes a curved front surface 70 and a plurality of ribs 58 which are positioned in alignment with the ribs 62 on the front section 34. As seen in FIGS. 4, 5 and 6, the front surface 70 has a curvature which forms a continuation of the curvature of the front section 60 of the center section 34.

Means are provided for engaging the end sections 36 and 38 with the edges 33 and 35 of the center section 34. Such means is in the form of outwardly bevelled edges 74 provided on the upper and lower edges of sections 36 and 38. The edges 74 are angled outwardly from the front surface to the back surface to matingly engage the inwardly inclined edges of the center section 34. The lower edge of the section 36 is located at the bottom of the grid 32 to matingly engage a ledge 50 provided on the bottom of the jaw 12 when the jaw die assembly 16 is positioned within the jaw crusher 12.

In this regard, each of the end sections 36 and 38 are provided with means in the form of two pairs of lifting lugs 76 for supporting the end sections 36 and 38 on the grid 32 when the die assembly is transported from an assembly point to the jaw 12 of the crusher. The lifting lugs 76 are located in position to slide into the holes 56 provided in the ribs 54. As more particularly described hereinafter, the lifting lugs 76 are aligned with the holes 56 to lock the end sections 36 and 38 to the grid when the grid is raised to a vertical position.

The jaw die assembly 16 is assembled by placing the upper section 38 and lower section 36 on the front of the support grid 32 with the lifting lugs 76 aligned with the opening 56 in the ribs 54. The jaw die assembly can be raised by attaching cables to the upper die sections 38. As the grid is raised the end section 38 is moved to the top and the lower pair of lifting lugs 76 on the upper section 38 will slide into the openings 56. As the grid is raised further the upper pair of lifting lugs 76 on the lower section 36 will slide into the holes 56 in the corresponding rib 54 in the grid to hold the lower section 36 on the grid. As the assembly 16 is lowered into the jaw 12, the lower edge 74 of the lower section 36 will seat on the ledge 50. The support grid 32 will slide downward behind the end section 36 until the lower edge 35 of the center section 34 seats against the upper edge 74 of the section 36. The upper edge 74 of the lower section 36 will then be located between ledge 50 and the center section 34. The upper section 38 will slide downward on the grid 32 until the lower end of the upper section 38 seats on the upper edge 33 of the center section 34.

The assembly 16 is locked into the jaw 16 by means of the wedge plate 26 which is provided with an inwardly inclined edge 80 corresponding to the upper edge 74 of the end section 38. The wedge plate 26 is drawn into the jaw by tightening the nuts 30 on the bolt 28 so that the edge 80 bears against the upper edge 74 of the section 38. The upper edge 80 will automatically cam the upper section 38, center section 34 and lower section 36 into the ledge 50.

RESUMÉ

The jaw die assembly of the present invention provides for a more efficient use of the high cost steel required for the wear plate sections. Each of the end sections, as well as the center section and support grid, are symmetrical. The support grid and center section are reversible. Each of the end sections is reversible and is interchangeable with the other end section on the support grid. The jaw die assemblies are automatically locked into position during assembly.

I claim:

1. In a jaw crusher of the type having a movable jaw, an improved multiple unit die assembly for each of the jaws, each said assembly comprising a support grid having a groove in the front equally spaced from each edge of the grid, a center die section secured in said groove in said support grid and a pair of symmetrical end sections positioned on said support grid and having a width equal to the distance between the center section and the edges of said support grid, said end sections including means on the back for engaging said support grid during movement from an assembly point to the jaw crusher, said engaging means comprising a lifting lug on each of said end sections and a corresponding hole in said support grid.

2. The assembly according to claim 1 wherein said center die section includes inwardly inclined upper and lower edges and said end sections include outwardly inclined edges corresponding to the inwardly inclined edges of said center die section, said outwardly inclined edges of said die sections engaging said inclined edges of said center section when mounted in the jaw crusher.

3. The assembly according to claim 1 wherein said center die section and said end sections are cast from manganese steel.

4. The assembly according to claim 1 wherein the support grid and center die section are symmetrical.

* * * * *